US005247900A

United States Patent [19]

Sobczak

[11] Patent Number: 5,247,900

[45] Date of Patent: Sep. 28, 1993

[54] LOCATION MARKER STAKE

[76] Inventor: Henry G. Sobczak, 101 Forest Ave., Hawthorne, N.J. 07506

[21] Appl. No.: 993,369

[22] Filed: Dec. 18, 1992

[51] Int. Cl.[5] ..... G09F 17/00

[52] U.S. Cl. ..... 116/209; 116/173; 116/211

[58] Field of Search ..... 33/293; 40/598; 52/103, 52/104, 105; 116/173, 174, 175, 209, 211; 248/530, 532, 533

[56] References Cited

U.S. PATENT DOCUMENTS

| | | | |
|---|---|---|---|
| Des. 234,098 | 1/1975 | Coumbs | 33/293 X |
| 1,631,566 | 6/1927 | Walton | 116/173 |
| 1,976,264 | 10/1934 | Miner et al. | 116/173 |
| 3,021,755 | 2/1962 | Karchenes | 116/63 P X |
| 3,767,355 | 10/1973 | Anderson, Jr. | 248/530 X |
| 4,050,404 | 9/1977 | McMackin | 116/209 |
| 4,520,985 | 6/1985 | Blumenthal | 248/530 |
| 4,524,533 | 6/1985 | Still, Jr. | 40/607 |
| 4,819,904 | 4/1989 | Shpigel et al. | 248/530 X |
| 4,852,512 | 8/1989 | Klatt | 116/209 |
| 4,923,164 | 5/1990 | Stenberg | 248/530 |

*Primary Examiner*—William A. Cuchlinski, Jr.
*Assistant Examiner*—W. Morris Worth
*Attorney, Agent, or Firm*—Leon Gilden

[57] ABSTRACT

A marker stake includes a ribbed spike having converging ribs directed towards a lowermost end for barring rotation of the spike, with the spike arranged for mounting an indicator shaft. The indicator shaft is arranged for removable mounting relative to the spike member, with a step plate arranged for removably mounting the organization relative to the spike member and the indicator shaft for indicating various geographical locations within a predetermined area.

4 Claims, 5 Drawing Sheets

FIG 14
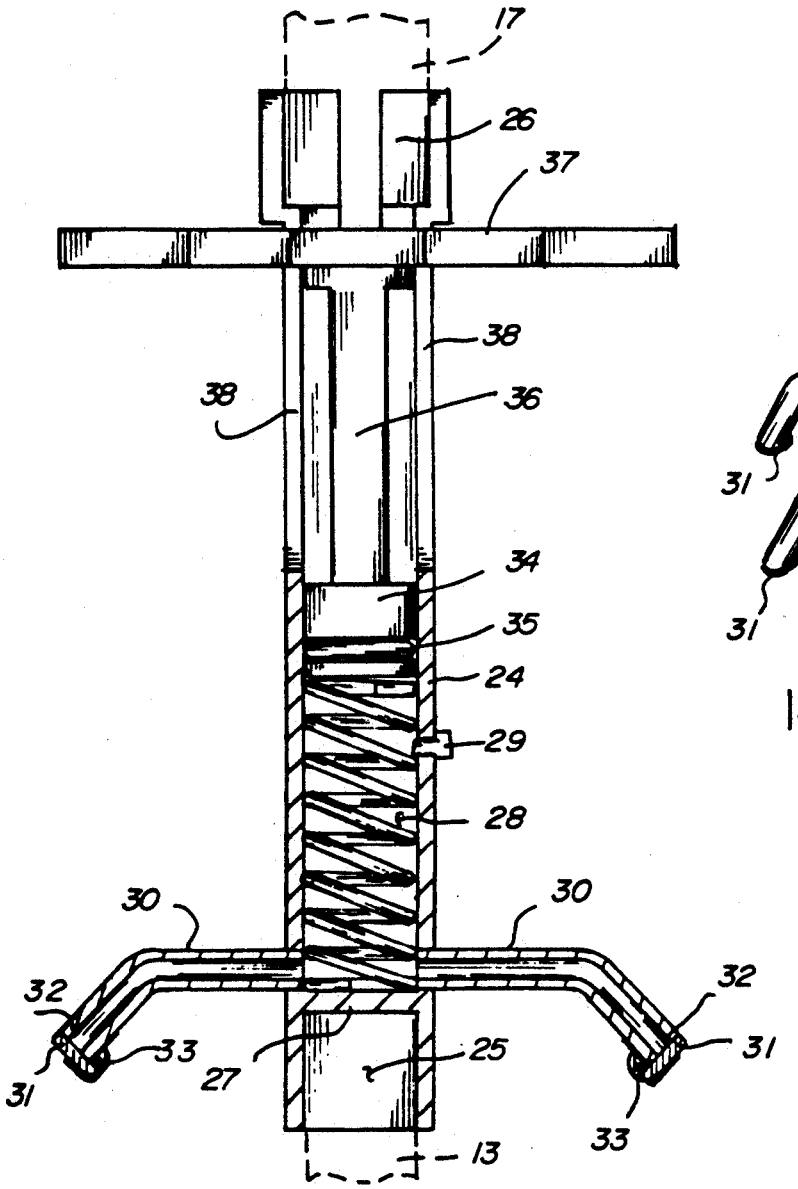
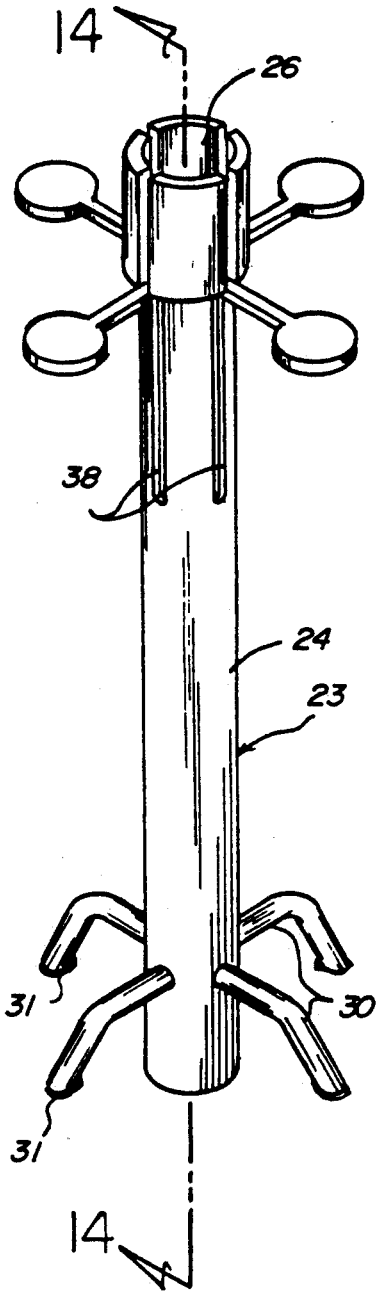
FIG 13

LOCATION MARKER STAKE

BACKGROUND OF THE INVENTION

1. Field of the Invention

The field of invention relates to marking organization, and more particularly pertains to a new and improved location marker stake wherein the same is arranged for ease of projection into an underlying ground surface for geographical locating and marking.

2. Description of the Prior Art

Marking stake structure is available in the prior art and exemplified by U.S. Pat. Nos. 4,050,404; 4,970,795; and 4,852,512.

The instant invention attempts to overcome deficiencies of the prior art by providing for a stake structure arranged for ease of assembly as well as for projection into an underlying ground surface and in this respect, the present invention substantially fulfills this need.

SUMMARY OF THE INVENTION

In view of the foregoing disadvantages inherent in the known types of marking apparatus now present in the prior art, the present invention provides a location marker stake wherein the same includes a plurality of components arranged for disassembly to permit the reuse of the indicator shaft and flag structure. As such, the general purpose of the present invention, which will be described subsequently in greater detail, is to provide a new and improved location marker stake which has all the advantages of the prior art marking apparatus and none of the disadvantages.

To attain this, the present invention provides a marker stake including a ribbed spike having converging ribs directed towards a lowermost end for barring rotation of the spike, with the spike arranged for mounting an indicator shaft. The indicator shaft is arranged for removable mounting relative to the spike member, with a step plate arranged for removably mounting the organization relative to the spike member and the indicator shaft for indicating various geographical locations within a predetermined area.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved location marker stake which has all the advantages of the prior art marking apparatus and none of the disadvantages.

It is another object of the present invention to provide a new and improved location marker stake which may be easily and efficiently manufactured and marketed.

It is a further object of the present invention to provide a new and improved location marker stake which is of a durable and reliable construction.

An even further object of the present invention is to provide a new and improved location marker stake which is susceptible of a low cost of manufacture with regard to both materials and labor, and which accordingly is then susceptible of low prices of sale to the consuming public, thereby making such location marker stakes economically available to the buying public.

Still yet another object of the present invention is to provide a new and improved location marker stake which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is an isometric illustration of a marker insert as employed by the invention.

FIG. 14 is an orthographic view, taken along the lines 14—14 of FIG. 13 in the direction indicated by the arrows.

DESCRIPTION OF THE PREFERRED EMBODIMENT

Figure 1:
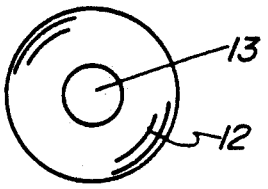
FIG. 1 is an orthographic top view of the stake portion of the invention.
Figure 2:
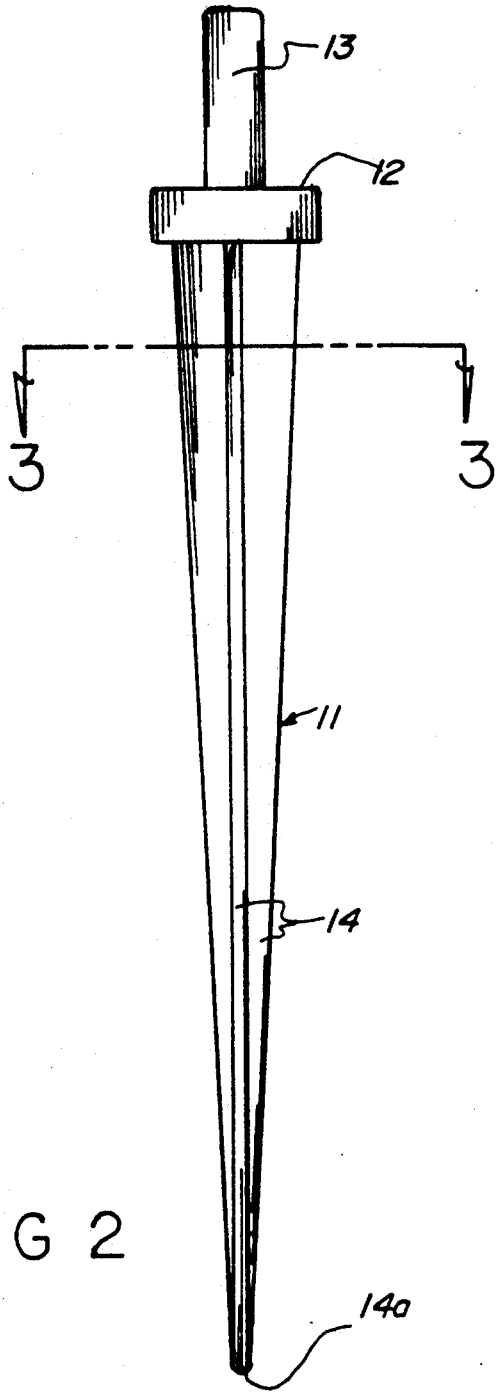
FIG. 2 is an orthographic side view of the stake portion of the invention.
Figure 3:
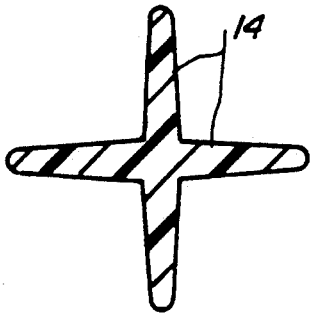
FIG. 3 is an orthographic view, taken along the lines 3—3 of FIG. 2 in the direction indicated by the arrows.
Figure 4:
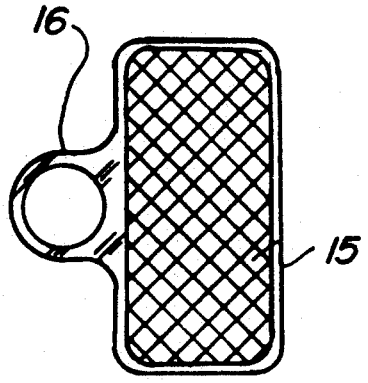
FIG. 4 is an orthographic top view of the step plate employed by the invention.
Figure 5:
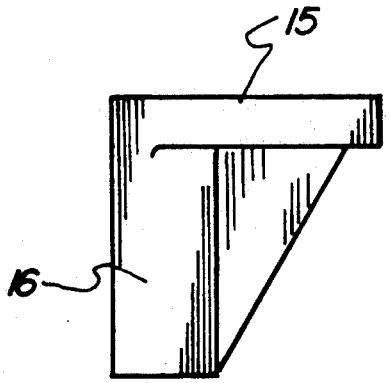
FIG. 5 is an orthographic side view of the step plate.
Figure 6:
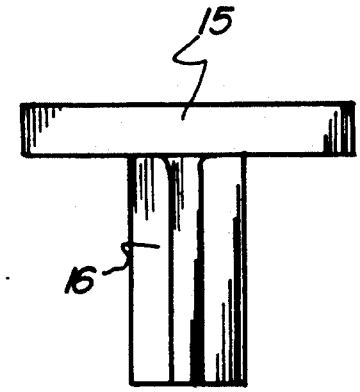
FIG. 6 is an orthographic end view of the step plate.
Figure 7:
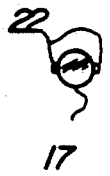
FIG. 7 is an orthographic top view of the indicator shaft.
Figure 8:
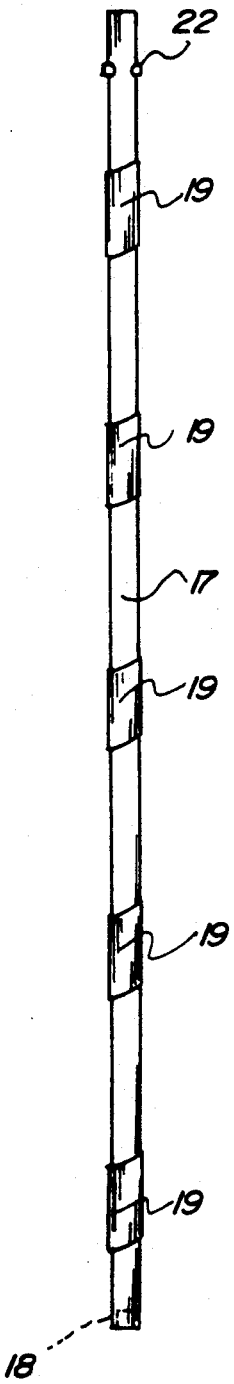
FIG. 8 is an orthographic side view of the indicator shaft.
Figure 9:
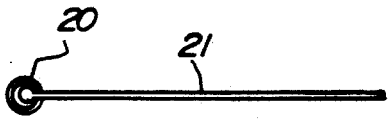
FIG. 9 is an orthographic top view of the flag member.
Figure 10:
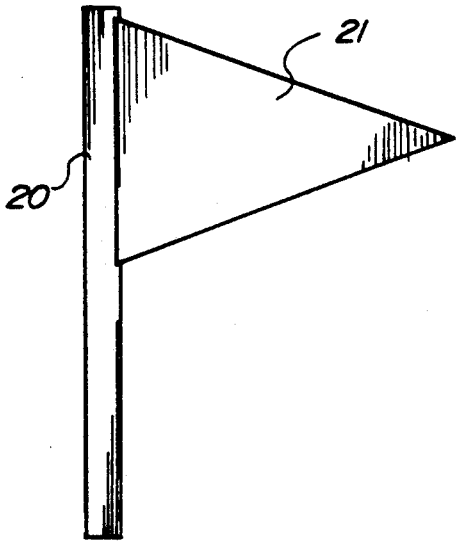
FIG. 10 is an orthographic side view of the flag member.
Figure 11:
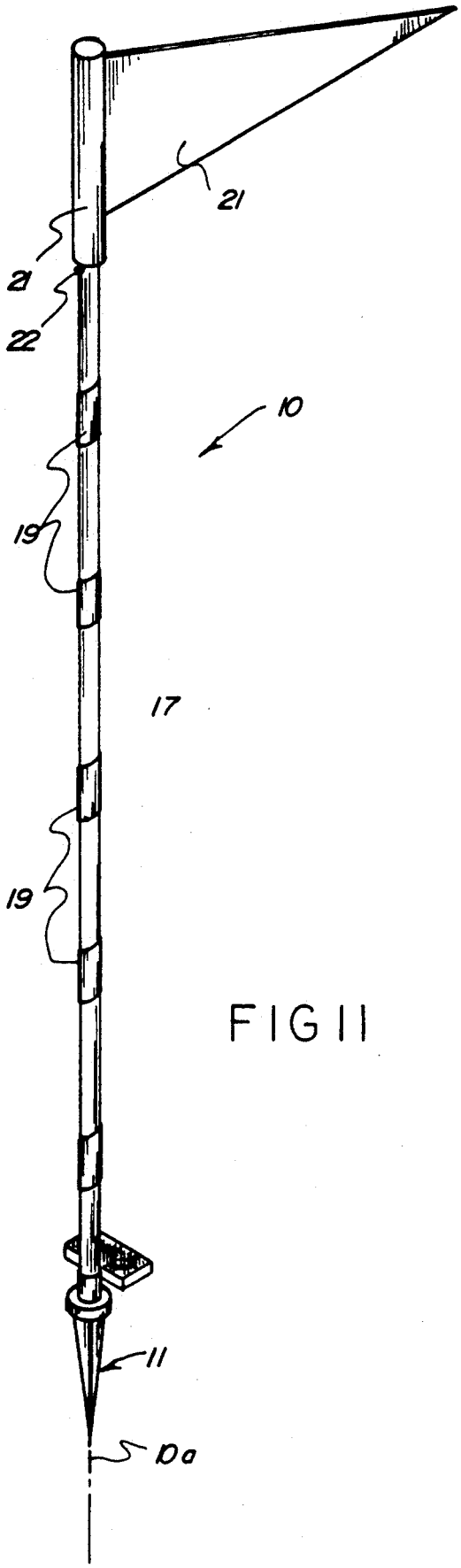
FIG. 11 is an isometric illustration of the invention in an assembled configuration.
Figure 12:
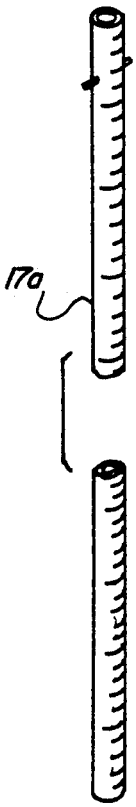
FIG. 12 is an isometric illustration of a modified indicator shaft structure.

With reference now to the drawings, and in particular to FIGS. 1 to 14 thereof, a new and improved location marker stake embodying the principles and concepts of the present invention and generally designated by the reference numeral 10 will be described.

More specifically, the location marker stake 10 of the instant invention essentially comprises a spike member 11, having an abutmment collar 12 at an uppermost end thereof terminating in a distal end 14*a* from the abutment collar 12. A plurality of longitudinal ribs 14 extend from the abutment collar 12 and converge at the distal end 14*a*, with a mounting shaft 13 coaxially aligned relative to the ribs 14 and the distal end 14*a*, with the mounting shaft 13 fixedly mounted in an orthogonal relationship relative to the abutment collar 12. A step plate 15 is provided that is arranged orthogonally relative to an axis 10*a* of the marking stake 10 (see FIG. 11), with the step plate having a step plate tube 16 arranged to receive the indicator shaft 17 when the indicator shaft 17 is mounted upon the mounting shaft 13, with the indicator shaft 17 having an indicator shaft socket 18 arranged to receive the mounting shaft 13 to thereby align the indicator shaft 17 and the spike member 11 about the predetermined axis 10*a* in a symmetrical orientation. The step plate thereby has the two-step plate tube 16 arranged for abutment upon the abutment collar 12 to provide for an individual to step upon the plate 15 to project the organization into an underlying ground surface. The ribs 14 prevent rotation of the structure when thusly directed into the ground. The indicator shaft 17 includes a plurality of spaced reflective bands 19 mounted about the indicator shaft 17 for ease of visibility relative to the shaft. If desired, the graduated shaft 17*a* may be provided, having the bands 19 positioned about the graduated shaft 17*a*. A flag tube 20 is provided, having a flag 21 mounted to the flag tube. A plurality of abutment pins 22 mounted to the indicator shaft 17 below the indicator shaft uppermost distal end is arranged to abut the flag tube 20 when the flag tube 20 is slid over the shaft 17 at the uppermost distal end thereof.

A marker insert 23 is provided for optional employment by the invention, wherein the marker insert 23 includes a tubular insert housing 24, having a housing lower socket 25 arranged to receive the mounting shaft 13, with a housing upper socket 26 arranged to receive the lowermost distal end of the indicator shaft 17. The housing includes a housing floor plate 27 in adjacency to the lower socket 25, wherein a housing fluid cavity 28 is positioned within the housing 24 between the floor plate 27 and a piston 34, with the piston 34 having a piston spring 35 interposed between the piston 34 and the floor plate 27. The fluid cavity is arranged to receive a marker dye therewithin, wherein a fill plug 29 directed into the housing 24 and in communication with the housing cavity 28 permits replenishment of the dye. Nozzle tubes 30 project radially from the fluid housing cavity 28 in adjacency to the housing floor plate 27, with the nozzle tubes 30 canted towards the lowermost socket to provide for dye about the spike member 11 when the piston 34 is projected against the floor plate 27 to express the dye through the nozzle tubes 30. Each nozzle tube 30 includes a nozzle tube exit port 32, each nozzle tube exit port 32 having a door plate 31 hingedly mounted about a spring hinge 33 to normally bias each door plate 33 in sealing relationship relative to the associated exit port 32. A plunger rod 36 is arranged in contiguous communication with the piston 34 extending from the piston 34 towards the upper socket 26. The plunger rod 36 includes a plurality of foot rods 37 extending from the plunger rod, with each of the foot rods 37 having sliding reception within a slot 38 extending between the upper socket to the housing cavity 28. In this manner, when dye is intended to be expressed and directed about the spike member 11 to permit removal of the spike member and leave the die as a marker, the marker insert 23 is merely inserted into the structure, as illustrated, and the dye directed therefrom.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A location marker stake, comprising, a spike member, the spike member having a plurality of longitudinal ribs, and an abutment collar, the ribs extending from the abutment collar and canted towards one another terminating in a pointed distal end, the abutment collar further including a first side, with the ribs extending from the first side, and the abutment collar having a second side, with a mounting shaft extending from the second side, with the mounting shaft, the abutment collar, and the ribs coaxially aligned about a predetermined axis, with the abutment collar orthogonally oriented relative to the axis, and an indicator shaft, the indicator shaft having an indicator shaft first end, the first end including an indicator shaft socket, with the indicator shaft socket receiving the mounting shaft, and the indicator shaft having a second end, and a plurality of abutment pins fixedly mounted to the indicator shaft spaced from and adjacent the second end, and a flag tube, the flag tube including a flag member mounted thereon, the flag tube arranged for reception over the second end for engagement with the abutment pins and including a step plate, the step plate having a step plate tube, and the step plate tube positioned in engagement with the abutment collar receiving the indicator shaft therethrough at the first end.

2. A location marker stake as set forth in claim 1 including a plurality of spaced reflective bands mounted about the indicator shaft.

3. A location marker stake as set forth in claim 2 including a marker insert, the marker insert arranged to include a tubular housing, the housing having a housing first end including a lowermost socket, and a housing second end having an upper socket, the upper socket arranged for receiving the indicator shaft first end, and the lower socket arranged for receiving the mounting shaft, with a floor plate positioned within the housing adjacent the lower socket, and a piston positioned within the housing spaced from the floor plate, and a spring interposed between the piston and the floor plate defining a fluid cavity therebetween, and a plurality of nozzle tubes projecting radially and in fluid communication with the cavity, and canted downwardly from the cavity towards the lower socket, with each of the tubes having an exit port, and each exit port including a door plate, each door plate having a spring hinge to hingedly mount the door plate into sealing engagement with a respective exit port.

4. A location marker stake as set forth in claim 3 including a plunger rod in contiguous communication with the piston positioned between the piston and the upper socket, and the plunger rod including a plurality of foot rods extending from the plunger rod projecting laterally and radially of the marker insert, with each of the rods received within a slot, with each slot positioned within the tubular insert housing directed between the upper socket and the cavity.

* * * * *